US007214026B2

(12) United States Patent
Hilvers et al.

(10) Patent No.: US 7,214,026 B2
(45) Date of Patent: May 8, 2007

(54) EASY MAINTENANCE AND/OR SERVICE UTILITY VEHICLE WITH EXTENDABLE UTILITY BOOM

(75) Inventors: Michael J. Hilvers, Fort Jennings, OH (US); John A. Garberson, Columbus Grove, OH (US)

(73) Assignee: Unverferth Manufacturing Company, Inc., Kalida, OH (US)

( * ) Notice: Subject to any disclaimer, the term of this patent is extended or adjusted under 35 U.S.C. 154(b) by 0 days.

(21) Appl. No.: 10/385,497

(22) Filed: Mar. 12, 2003

(65) Prior Publication Data

US 2003/0175105 A1 Sep. 18, 2003

Related U.S. Application Data

(60) Provisional application No. 60/364,025, filed on Mar. 15, 2002.

(51) Int. Cl.
*E02F 3/627* (2006.01)

(52) U.S. Cl. ..... 414/685; 414/686

(58) Field of Classification Search ..... 414/685, 414/686, 680; 180/89.13–89.18
See application file for complete search history.

(56) References Cited

U.S. PATENT DOCUMENTS 3,869,018 A * 3/1975 Muller ..... 180/89.17
4,401,179 A * 8/1983 Anderson ..... 180/89.14
4,405,280 A * 9/1983 Cochran et al. ..... 414/685
5,169,278 A * 12/1992 Hoechst et al. ..... 414/685
5,518,358 A * 5/1996 Aschroft et al. ..... 414/685
5,551,826 A * 9/1996 Todd et al. ..... 414/685
5,918,694 A * 7/1999 Miller et al. ..... 180/89.14
6,543,563 B1 * 4/2003 Muraro ..... 180/89.12

OTHER PUBLICATIONS

GEHL, "The New 7000 Series Skid Loaders", Brochure.
John Deere, "200 Series Skid Steers 53—to 82—HP," Brochure.
John Deere, "Skid—Steer Loaders," Brochure.
Case, "85XT/90XT/95XT Skid Steers, " Brochure.

* cited by examiner

*Primary Examiner*—Donald Underwood
(74) *Attorney, Agent, or Firm*—Rothwell, Figg, Ernst & Manbeck, P.C.

(57) ABSTRACT

In preferred embodiments, a utility vehicle (such as, e.g., a skid steer vehicle) having a raised and lowered utility boom includes: a vehicle body; an engine supported within the vehicle body; a boom supported over the body; a utility mechanism supported on the boom; an operator cab supported on the vehicle body; and a forward tilt mechanism about which the cab tilts forward for maintenance or service; and a boom linkage moveable between a retracted position and an extended position; wherein, in the extended position the boom linkage provides a substantially unobstructed access to the vehicle body from left and right sides of the vehicle. The vehicle can also include a removable cover that enables access to the vehicle body behind the cab and/or a rear-end door that enables access from a rear end of the vehicle for maintenance or service.

18 Claims, 13 Drawing Sheets

EASY MAINTENANCE AND/OR SERVICE UTILITY VEHICLE WITH EXTENDABLE UTILITY BOOM

The present application claims priority to Provisional Patent Application Ser. No. 60/364,025, filed on Mar. 15, 2002, the entire disclosure of which is incorporated herein by reference.

BACKGROUND

1. Field of the Invention

The present invention relates generally to, among other things, utility vehicles having an extendable utility boom and certain preferred embodiments relate, more particularly, to vehicles having heavy duty boom linkages, including, e.g., various skid loaders and the like.

2. Discussion of the Background

There are a variety of known utility vehicles having extendable utility booms. These boomed utility vehicles are often used for construction and/or other utilitarian purposes, such as, e.g., for lifting, pushing, scraping, digging, plowing and/or various other purposes. In many instances, the vehicles include a) a main body having at least one seat for a vehicle operator (such as, for example, a seat located within a protective cab), b) wheels and/or other supports mounted on the body portion for supporting the same, c) a raised and/or lowered utility boom, and d) a utility mechanism mounted to the utility boom. In some illustrative cases, the utility mechanism mounted to the utility boom can include, e.g., one or more of the following: a) an auger; b) a backhoe; c) a dozer blade; e) a bucket; f) a fork (e.g., for pallets, manure or the like); g) a grinder; h) a rake; i) shears; j) a roller; k) spike (e.g., for bails of hay or the like); l) a jig boom; m) a broom; n) a scraper; o) a tree spade; p) a plow; q) a mower; r) a trencher; s) a four-in-one bucket; and/or various other utility mechanisms.

Because these vehicles are often used for work related purposes, ease of maintenance and/or service can often be important for increased work efficiency and/or increased performance capabilities. Nevertheless, existing devices often have access limitations rendering maintenance and/or service of such devices relatively problematic and/or cumbersome. These ease-of-access deficiencies can in many cases decrease work efficiency and/or performance. Thus, these ease-of-access deficiencies can often result in decreased production, increased costs and/or other drawbacks.

For example, boomed utility vehicles, such as, e.g., various skid loaders or skid steers (such as, e.g., wherein the vehicles front wheels skid rather than turning) often have a vehicle body with a boom structure that rises vertically from the vehicle body. This boom structure typically hinders service and/or maintenance by obstructing parts, such as, e.g., engine and/or drive systems, requiring service and/or maintenance.

For example, most skid loaders or the like have pivot points for their booms that are located in a position that results in obstruction of maintenance and/or service abilities (such as, e.g., pivot points located on wide pillars above a vehicle body) and/or include cabs that tilt around pivot points that are located in a position that results in obstruction of maintenance and/or service abilities (such as, e.g., pivot points located proximate a rear of a cab).

As some examples, certain XT SERIES skid loaders manufactured by CASE CORPORATION include, among other deficiencies, an obstructive boom structure with, for example, wide pillars that obstruct maintenance and/or service abilities. In addition, certain 200 SERIES skid loaders manufactured by JOHN DEERE, such as the 270 MODEL, includes, among other deficiencies, a rearwardly pivoted cab and an obstructive boom structure with, for example, wide pillars that obstruct maintenance and/or service abilities. In addition, the JOHN DEERE 7775 MODEL includes, among other deficiencies, a cab-over feature that attempts to make repair work easier but that requires special tools for operation and use. In addition, certain skid loaders manufactured by GEHL CO., i.e., their 7800 MODEL, include, among other deficiencies, a cab structure that pivots towards the rear and obstructs maintenance and/or service abilities.

There remains a need for, among other things, improved vehicles having a raised and/or lowered utility boom, such as, e.g., improved skid loaders.

SUMMARY OF THE PREFERRED EMBODIMENTS

The preferred embodiments of the present invention can significantly improve upon existing systems and methods.

In some preferred embodiments, a utility vehicle is provided that facilitates access to enhance maintenance and/or service. Preferably, a substantially unobstructed (e.g., wide-open) range of access is provided that facilitates maintenance and/or service. In the preferred embodiments, a maintenance and/or service operator may stand to the left side of the vehicle, to the right side of the vehicle and/or to the rear side of the vehicle while performing maintenance and/or service on the vehicle without significant obstruction. Moreover, in the preferred embodiments, the maintenance and/or service operator can readily achieve this access without the need for additional tools or implements.

In some illustrative embodiments, a utility vehicle having an extendable utility boom is provided that includes: a vehicle body; an engine supported within the vehicle body; a boom supported over the body; a utility mechanism supported by the boom; an operator cab supported by the vehicle body; and a forward tilt mechanism about which the cab tilts forward for maintenance or service and a boom linkage moveable between a retracted position and an extended position, wherein in the extended position the boom linkage provides substantially unobstructed access to the vehicle body from left and right sides of the vehicle from between a substantial portion of a fore-to-aft length of the vehicle body.

In some illustrative embodiments, a utility vehicle having an extendable utility boom is provided that includes: a vehicle body; an engine supported within the vehicle body; an extendable boom supported over the body; a utility mechanism supported on the boom; an operator cab supported on the vehicle body; and means for providing substantially unobstructed access to the engine along left and right sides of the vehicle body from locations beneath the cab and beneath the boom to proximate a rear end of the vehicle body. Preferably, the means includes a below-cab access mechanism that provides access to the engine by movement of the cab forward without additional tools and a boom linkage that provides substantially unobstructed access on right and left sides of the vehicle. In addition, a rear-end door that allows for access across substantially the entire rear end of the vehicle body and a removable top cover that provides access over substantially the entire top side of the engine behind the cab are preferably provided.

In some illustrative embodiments, a method of providing maintenance or service to a utility vehicle having an extendable boom can include: providing a utility vehicle having: a vehicle body, an engine supported within the vehicle body, a boom supported over the body, a utility mechanism supported on the boom, and an operator cab supported on the vehicle body; raising the boom into a position providing substantially unobstructed access under the boom at left and right sides of the vehicle; and tilting the cab forward around a forward tilt mechanism and maintaining the cab in a forward tilted position without additional tools. Additionally, the method preferably includes: removing a cover over a top of the engine to provide access to of the vehicle body behind the cab; and/or opening a rear-end door that provides access from a rear of the vehicle for maintenance or service.

The above and/or other aspects, features and/or advantages of various embodiments will be further appreciated in view of the following description in conjunction with the accompanying figures. Various embodiments can include and/or exclude different aspects, features and/or advantages where applicable. In addition, various embodiments can combine one or more aspect or feature of other embodiments where applicable. The descriptions of aspects, features and/or advantages of particular embodiments should not be construed as limiting other embodiments or the claims.

BRIEF DESCRIPTION OF THE DRAWINGS

The accompanying figures, in which similar reference numerals show similar elements, are provided by way of example, without limiting the broad scope of the invention or various other embodiments, wherein.

DETAILED DESCRIPTION OF THE PREFERRED EMBODIMENTS

While the present invention may be embodied in many different forms, a number of: illustrative embodiments are described herein with the understanding that the present disclosure is to be considered as providing examples of the principles of the invention and that such examples are not intended to limit the invention to preferred embodiments described herein and/or illustrated herein.

The preferred embodiments of the invention provide improved vehicles having a raised and/or lowered utility boom, such as, e.g., improved skid loaders. While preferred embodiments described herein show skid loaders, it should be appreciated that the various embodiments may be employed within any appropriate vehicle type. Additionally, while some preferred embodiments have a bucket 130 connected to the boom, it should be appreciated that the various embodiments may employ any other appropriate utility mechanism, such as, for example, any of the various utility mechanisms discussed herein.

In some preferred embodiments, a skid steer loader is provided that facilitates access to enhance maintenance and/or service ability. In preferred embodiments, the maintenance and/or service ability includes maintenance and/or service ability related to engine and/or drive systems (such as, e.g., engine and/or drive systems effecting transport of the vehicle and/or effecting operation of vehicle components, such as boom and/or other components). The most preferred embodiments enable a wide-open range of access to facilitate maintenance and/or service. Preferably, substantially wide-open access is available at both left and right lateral sides of the vehicle. Preferably, substantially wide-open access is also available at a rear side of the vehicle. In the most preferred embodiments, the wide-open access to the left side, the right side and/or the rear side may be provided without the need for additional tools or implements. Thus, in the preferred embodiments, a maintenance and/or service operator may stand to the left side of the vehicle, to the right side of the vehicle and/or to the rear side of the vehicle while performing maintenance and/or service on the vehicle without significant obstruction. Moreover, in the preferred embodiments, the maintenance and/or service operator can readily achieve this access without the need for additional tools or implements.

FIGS. 1(A)–3 show illustrative vehicles (in this example, skid steer loaders) 100 in accordance with some preferred embodiments of the present invention.

Figure 1A:
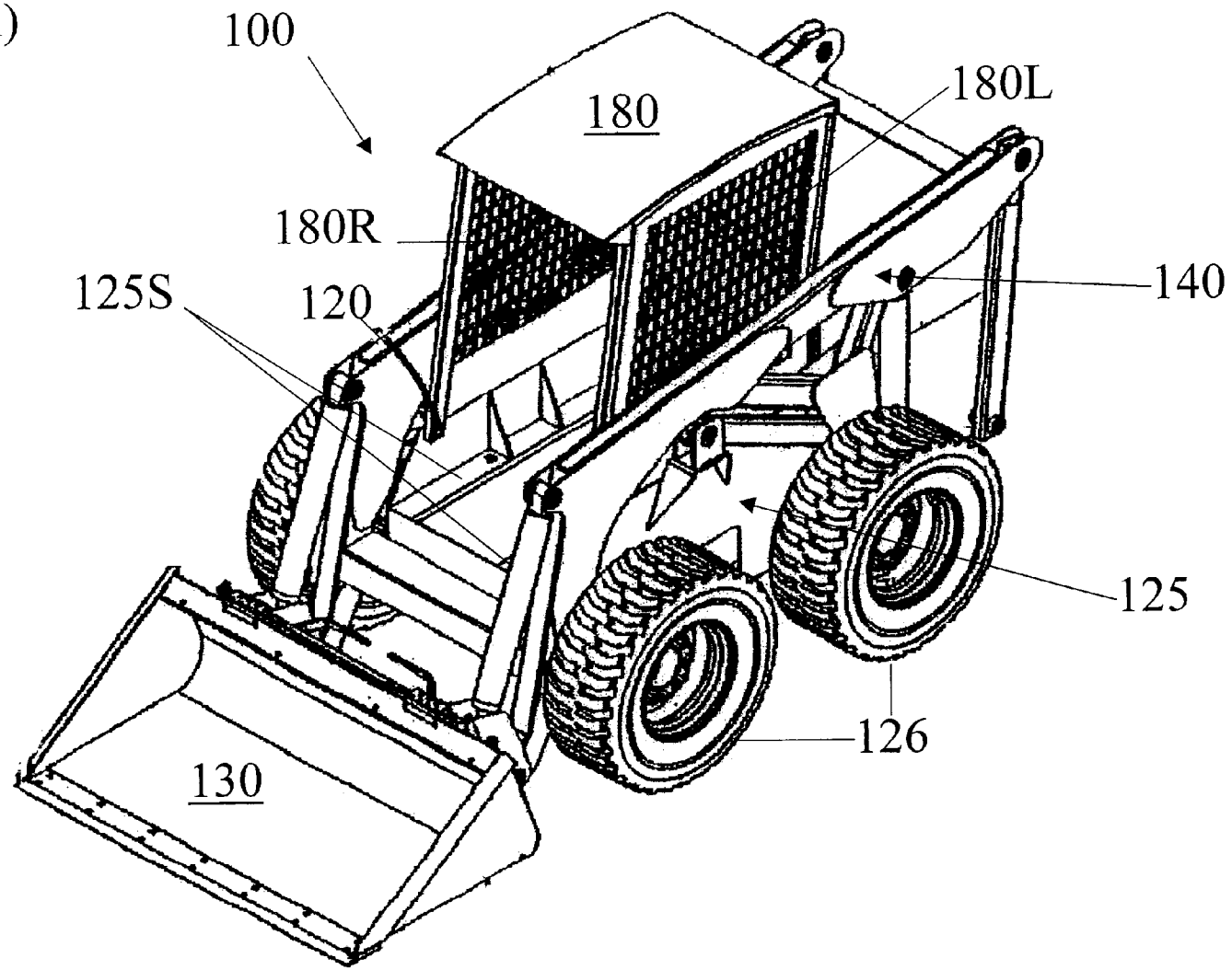
FIG. 1(A) is a front left perspective view of a skid steer vehicle with a boom in a lowered position according to some illustrative embodiments of the invention.
Figure 1B:
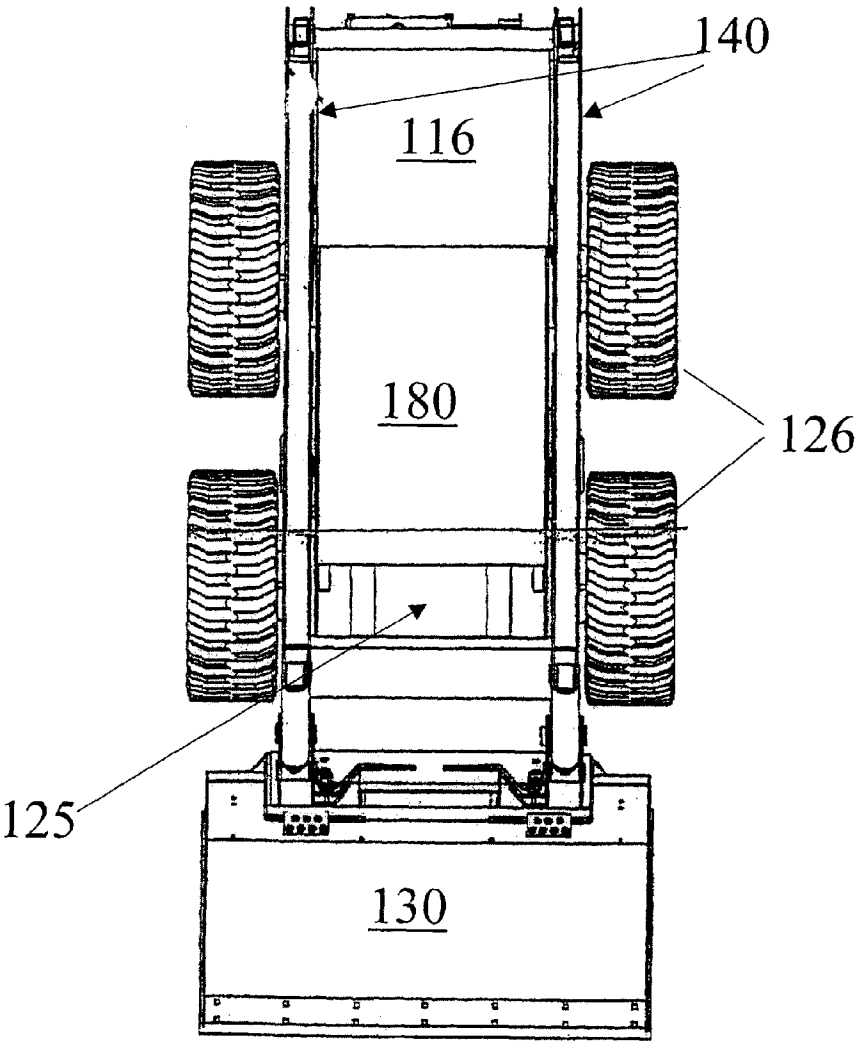
FIG. 1(B) is a top view of the skid steer vehicle shown in FIG. 1(A)
Figure 1C:
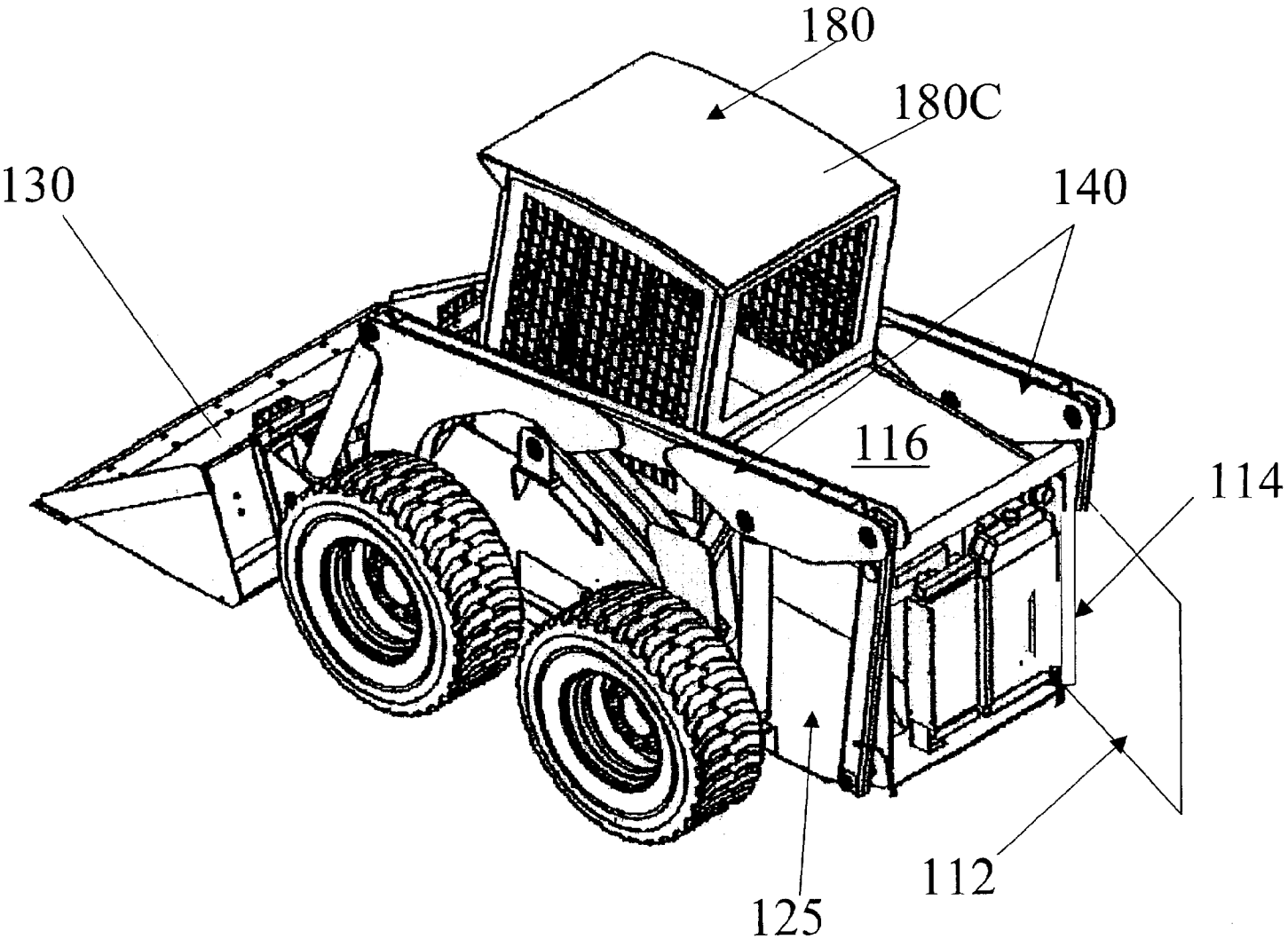
FIG. 1(C) is a rear left perspective view of a skid steer vehicle shown in FIG. 1(A)
Figure 1D:
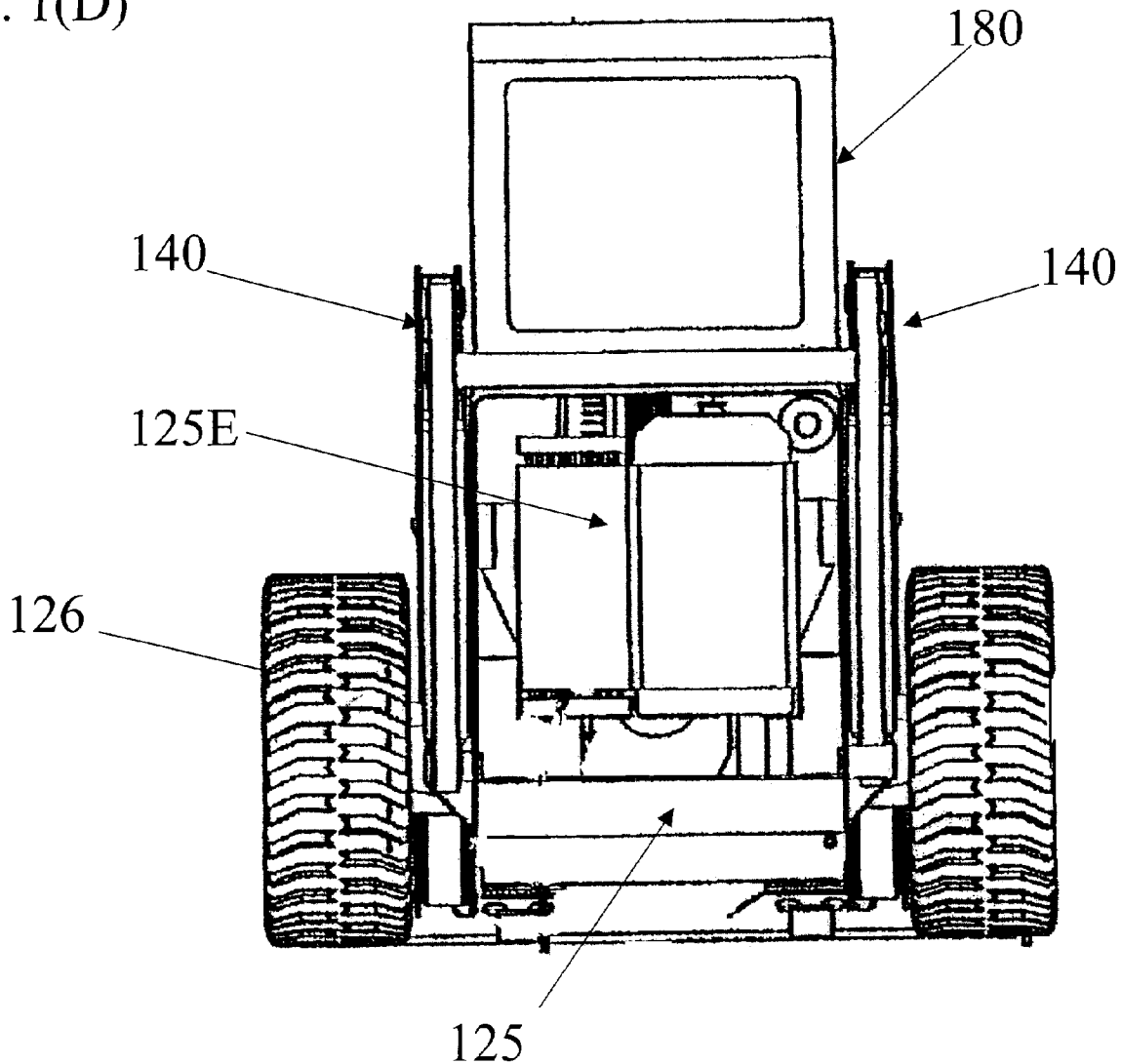
FIG. 1(D) is a rear view of the skid steer vehicle shown in FIG. 1(A)
Figure 1E:
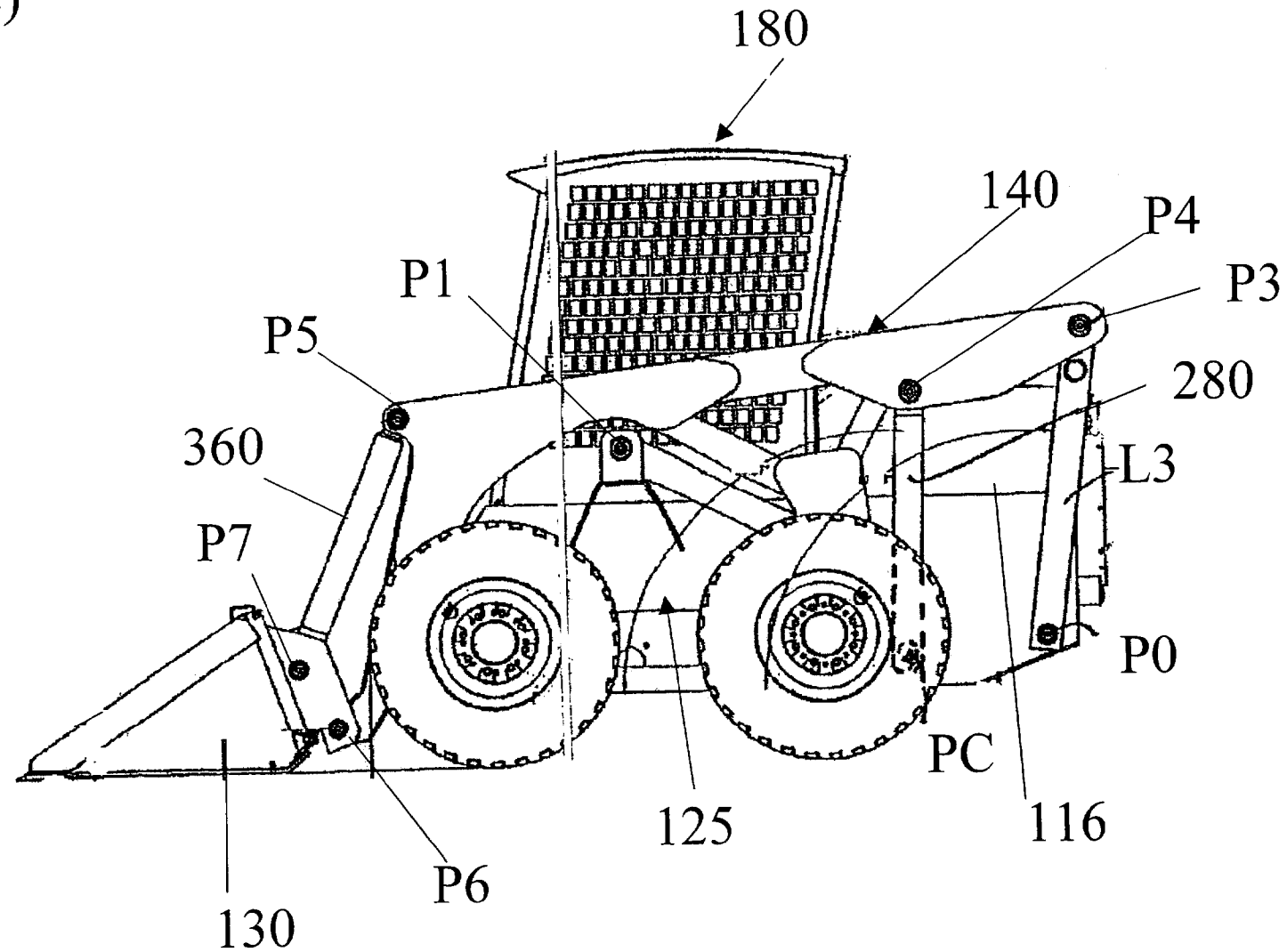
FIG. 1(E) is a left view of the skid steer vehicle shown in FIG. 1(A)
Figure 1F:
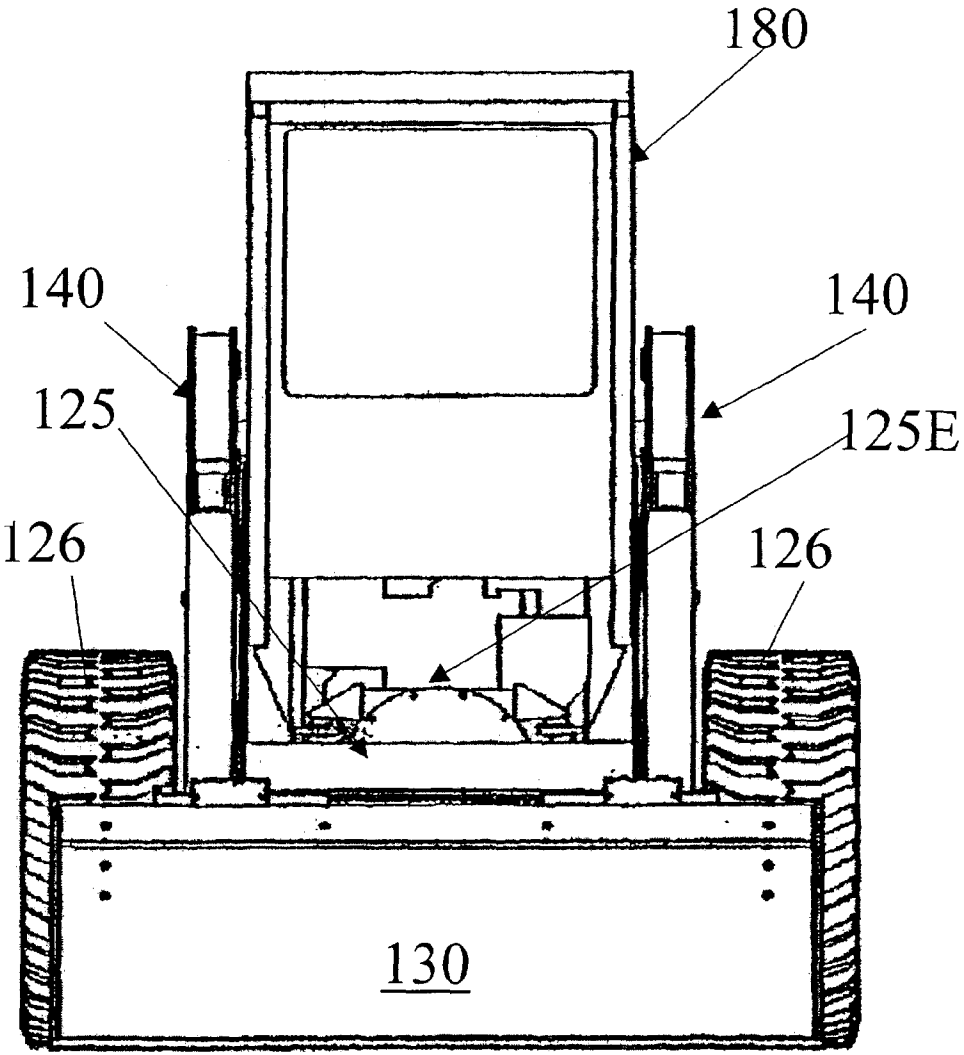
FIG. 1(F) is a front view of the skid steer vehicle shown in FIG. 1(A)

In that regard, FIGS. 1(A)–1(F) show an illustrative embodiment of a skid steer vehicle with a boom in a lowered position. Specifically, FIG. 1(A) shows a front left perspective view of an illustrative skid steer vehicle, FIG. 1(B) shows a top view of the skid the vehicle, FIG. 1(C) shows a rear left perspective view of the vehicle, FIG. 1(D) shows a rear view of the vehicle, FIG. 1(E) shows a left view of the vehicle and FIG. 1(F) shows a front view of the vehicle.

As illustrated, the vehicle 100 preferably includes a main body 125. In the illustrated embodiment, the main body 125 is movably supported via a plurality of wheels 126. While the illustrated embodiments include four wheels, other embodiments can include any other number of wheels and/or can include other support mechanisms such as belts, stabilizers and/or the like. As mentioned above, while the wheels 126 can provide skid steering, other embodiments could include or use other forms of steering.

Below-Cab Access:

In some preferred embodiments, to enhance maintenance and/or service ability, a below cab access feature is provided. Preferably, this feature provides access below the cab without obstructing access to a rear side of the cab. In this regard, in preferred embodiments, the vehicle 100 includes a cab 180 having at least one seat 180S, such as, e.g., shown in FIG. 3, fixedly mounted therein. For example, the cab can include, in some embodiments, an integral floor (not shown) and the seat 180S can be mounted upon the floor. In preferred embodiments, the cab 180 includes left and/or right protective side walls 180L and/or 180R (such as, e.g., including a lattice or grid-work of metal bars as shown) and/or a protective cover 180C. Preferably, the cab 180 is mounted via a mechanism that enables the cab to move towards a front of the vehicle for maintenance purposes. In that regard, the cab 180 is preferably mounted so as to pivot towards a front of the vehicle. The cab 180 is preferably mounted so as to pivot with respect to the body 125 via a hinge 120 located proximate a front side of the cab. The hinge 120 can include, e.g., one or more pivot mechanism between the body 125 and the cab 180 (such as, e.g., on left and/or right sides of the cab 180). In this manner, the cab 180 can preferably be pivoted forward to a maintenance and/or service position, such as, e.g., shown in FIG. 3. In some preferred embodiments, this below cab access feature enables access to engine and/or drive systems supported upon the body at a location, at least partly, otherwise obstructed by the cab 180, such as, e.g., at least partly below the cab during normal operation of the vehicle.

Figure 3:
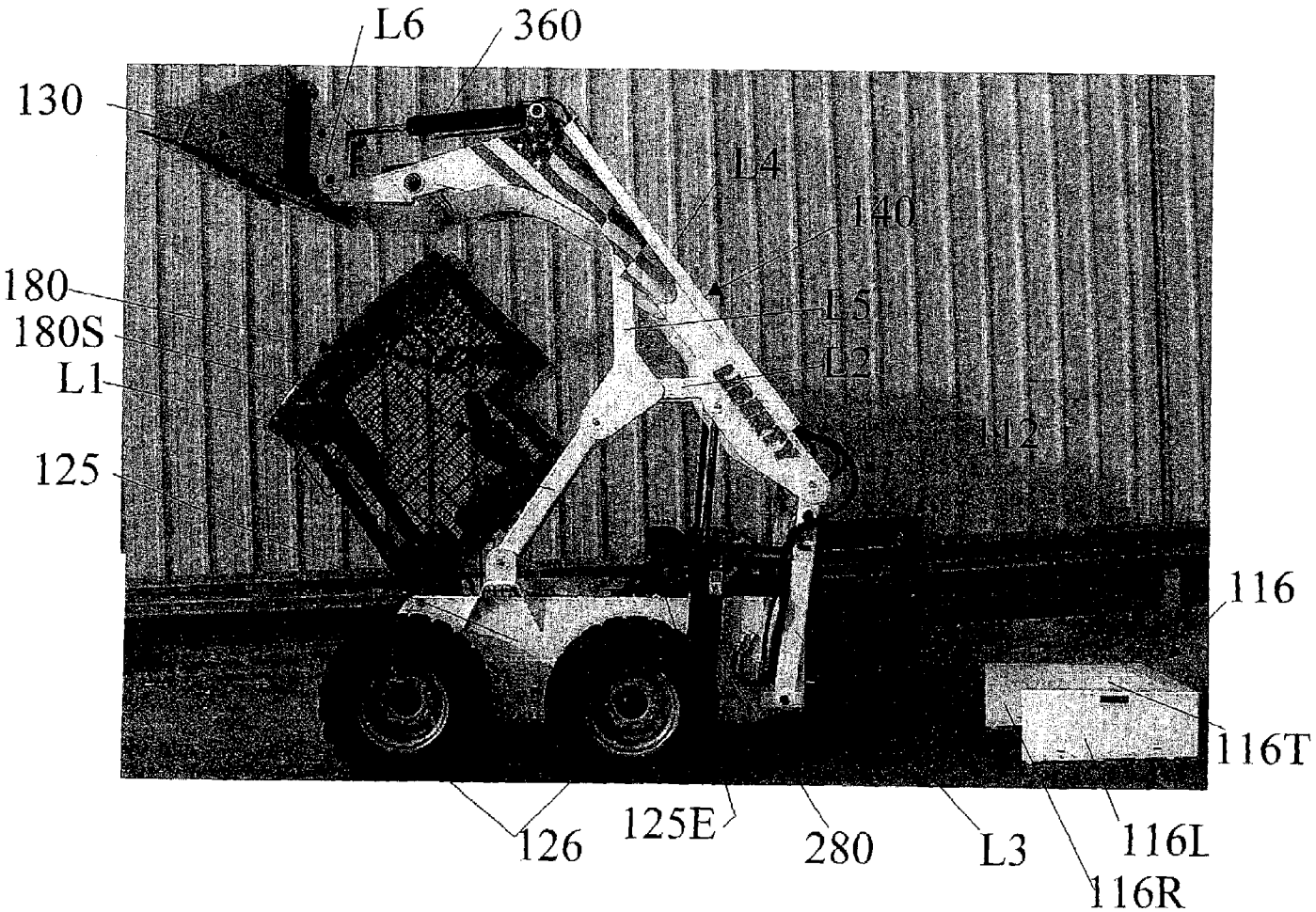
FIG. 3 is a side view of a skid steer vehicle according to some illustrative embodiments in an illustrative maintenance and/or service position with a non-obstructive raised boom, a removable cover and/or an open rear door.

Rear-End Access:

In some preferred embodiments, to enhance maintenance and/or service ability, a rear-end access feature is provided. Preferably, the rear-end access feature enables substantially unobstructed access by a maintenance and/or service operator from a rear-end of the vehicle. In some preferred embodiments, the rear end of the vehicle is accessible during maintenance and/or service via a door providing access through a rear end of the vehicle body. In some preferred embodiments, the door can be pivoted open. Preferably, the door can be pivoted around a generally vertical pivot to facilitate access. In illustrative embodiments, access to engine and/or drive systems (such as, e.g., motor parts) can be provided through a rear door 112 having a hinge 114 at a right rear corner of the body 125, as shown in FIG. 3. In that regard, FIG. 3 shows door 112 in the open position.

Preferably, the door 112 extends across substantially the entire width of rear-end of the vehicle body 125, from a left side to a right side of the vehicle body 125. In addition, the door 112 preferably extends across substantially the entire height of the rear-end of the vehicle body 125, from a bottom to a top of the vehicle body 125. In this manner, when the door is open, a maintenance and/or service operator can readily stand to the rear of the vehicle and have substantially full access therein.

Behind-Cab Access:

In some preferred embodiments, to enhance maintenance and/or service ability, a behind-cab access feature is provided. Preferably, this feature enables substantially unobstructed access at locations behind a vehicle cab. In this regard, in some preferred embodiments, the body 125 extends further rearward than the cab 180, such as, e.g., shown in FIGS. 1(E). In the preferred embodiments, a cover 116 is preferably provided that covers an interior of the body (such as, e.g., covering engine and/or drive systems and/or the like). Preferably, the cover 116 includes a top wall 116T, a left wall 116L and/or a right wall 116R. In this manner, in order to provide further access to the interior of the body 125, the cover 116 can be removed. In some embodiments, the cover can be fully removed and separated from the vehicle, such as shown in FIG. 3. The cover 116 can be removably mounted in a variety of ways. Any removable attachment means can be used, such as, e.g., clips, levers, bolts and/or various other means. Additionally, the cover can be constructed so as to be retained by the cab 180 and/or the door 112 in a manner such that when the cab 180 and/or door 112 are in an access position, the cover can be readily removed. While the cover 116 is preferably removed for access, in some embodiments, the cover 116 can be retained on the vehicle, such as, e.g., being fixed to the cab 180 so as to move forward therewith or the like. Among other things, easy removal of a cover can provide easy access to a vehicle transport engine 125E as shown in FIG. 3.

Left and/or Right Side Access:

In some preferred embodiments, to enhance maintenance and/or service ability, a left and/or right side access feature is provided. In this regard, the boom is preferably configured in a manner to enable substantially unobstructed left and/or right side access into the vehicle body. In preferred embodiments, a boom is provided that can be located in a lowered position (such as, e.g., shown in FIGS. 1(A)–1(F)) and/or in a raised position (such as, e.g., shown in FIGS. 2(A)–2(F)). In preferred embodiments, a boom linkage is provided that is in a retracted state when the boom is in the lowered position and in an expanded state when the boom is in the raised position. In the retracted state, at least some boom linkage elements are preferably proximate one another, such as shown, e.g., in FIG. 1(E), while in the expanded state, at least some of the boom linkage elements are preferably further separated from one another. Preferably, in an expanded state, the boom linkage elements are separated sufficiently to provide substantially unobstructed left and/or right side access that enables a maintenance and/or service operator to freely access the interior of the vehicle 125, such as the engine and/or drive systems, from left and/or right sides of the vehicle.

In some preferred embodiments, the left and/or right side access involves substantially unobstructed access to an interior of the vehicle from left and/or right sides of the vehicle. Preferably, the substantially unobstructed access is along left and/or right sides of the vehicle from a position proximate a front end of the vehicle to a position proximate a rear end of the vehicle. In some preferred embodiments, the substantially unobstructed access is along left and/or right sides of the vehicle from a position proximate a rear side of the cab, when in its forward position, to a position proximate a rear end of the vehicle, such as, e.g., shown in FIG. 3. In that regard, FIG. 3 shows a side view of a vehicle according to some illustrative embodiments in an illustrative maintenance and/or service position with a) a raised boom configured to provide substantially unobstructed left and right side access, b) a removable cover configured to enable substantially unobstructed access behind the cab location and c) a pivotally mounted rear door configured to enable substantially unobstructed access from a rear end of the vehicle.

Figure 2A:
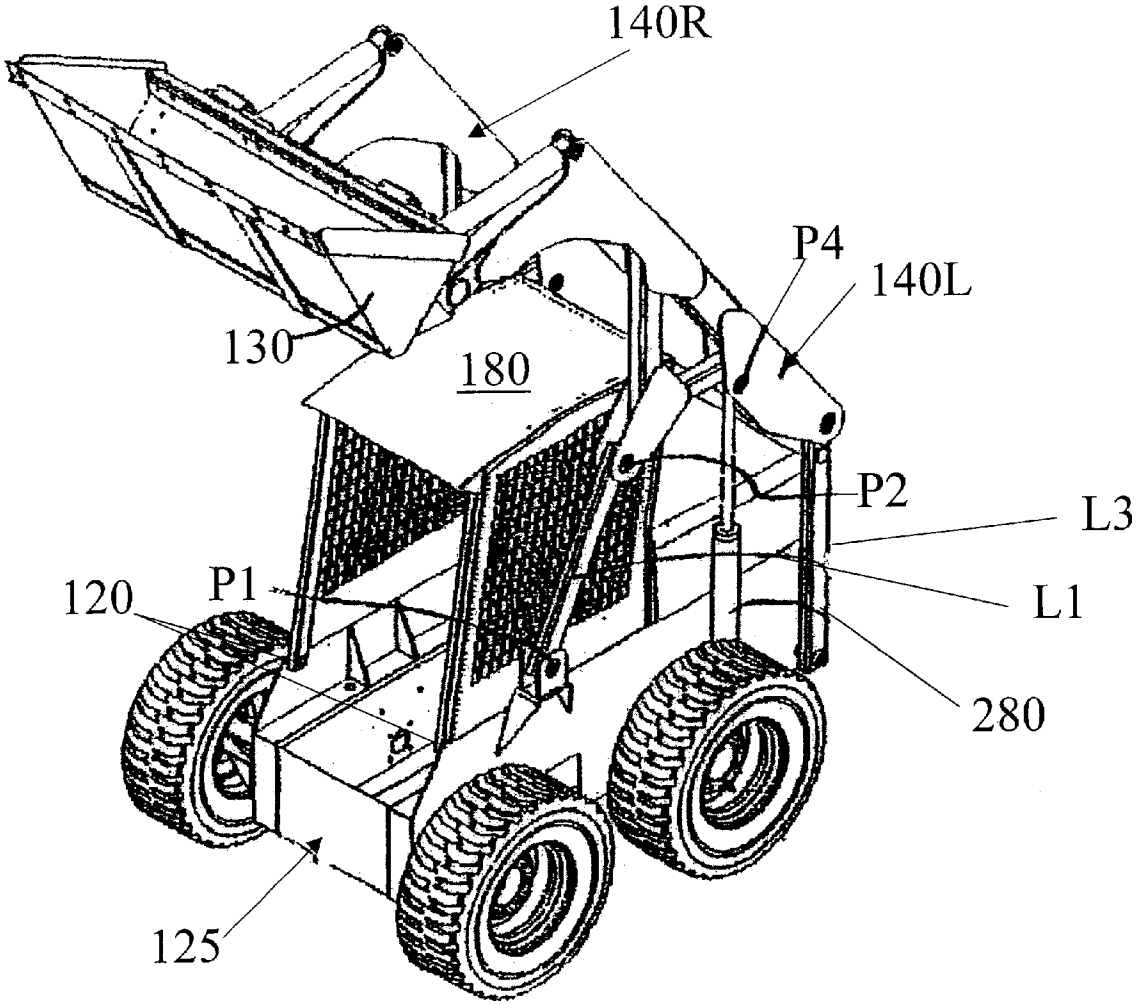
FIG. 2(A) is a front left perspective view of a skid steer vehicle with a boom in a raised position according to some illustrative embodiments of the invention.
Figure 2B:
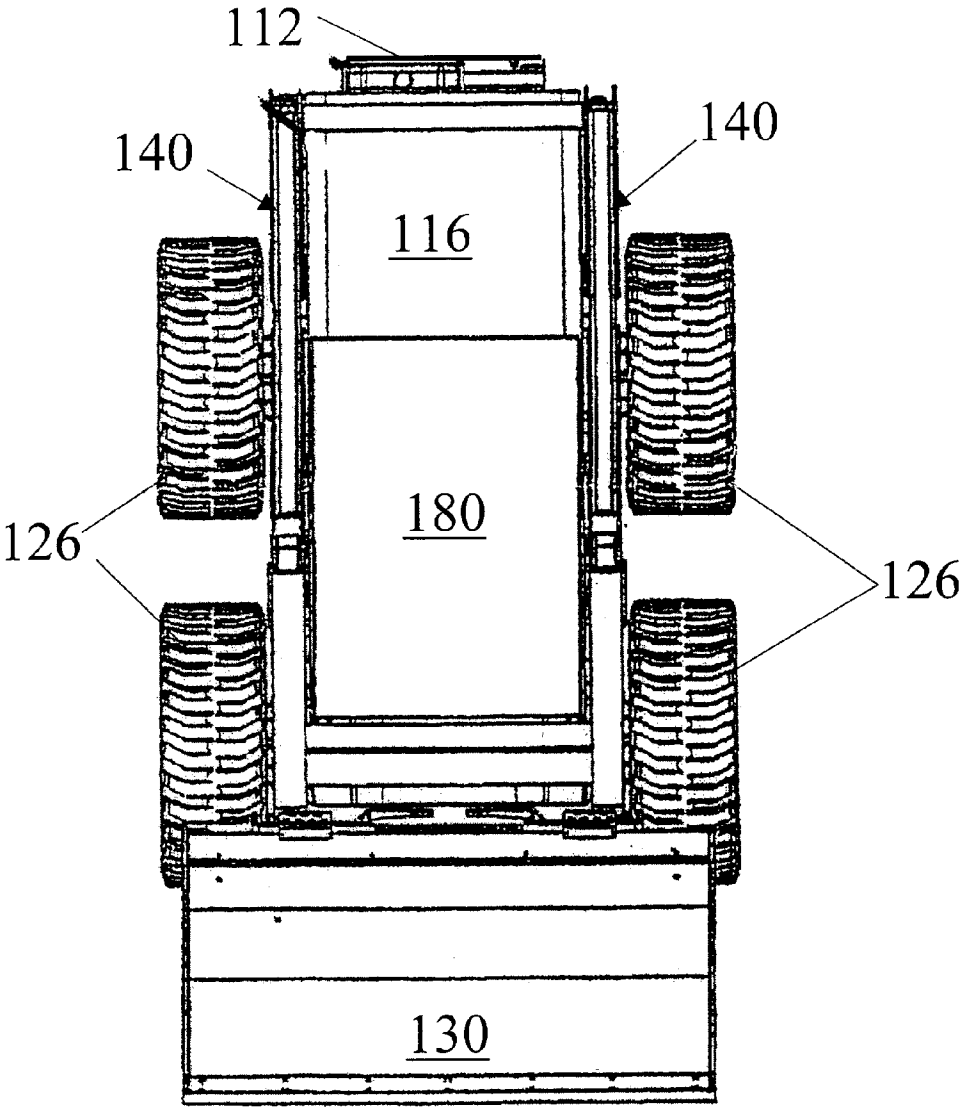
FIG. 2(B) is a top view of the skid steer vehicle shown in FIG. 2(A)
Figure 2C:
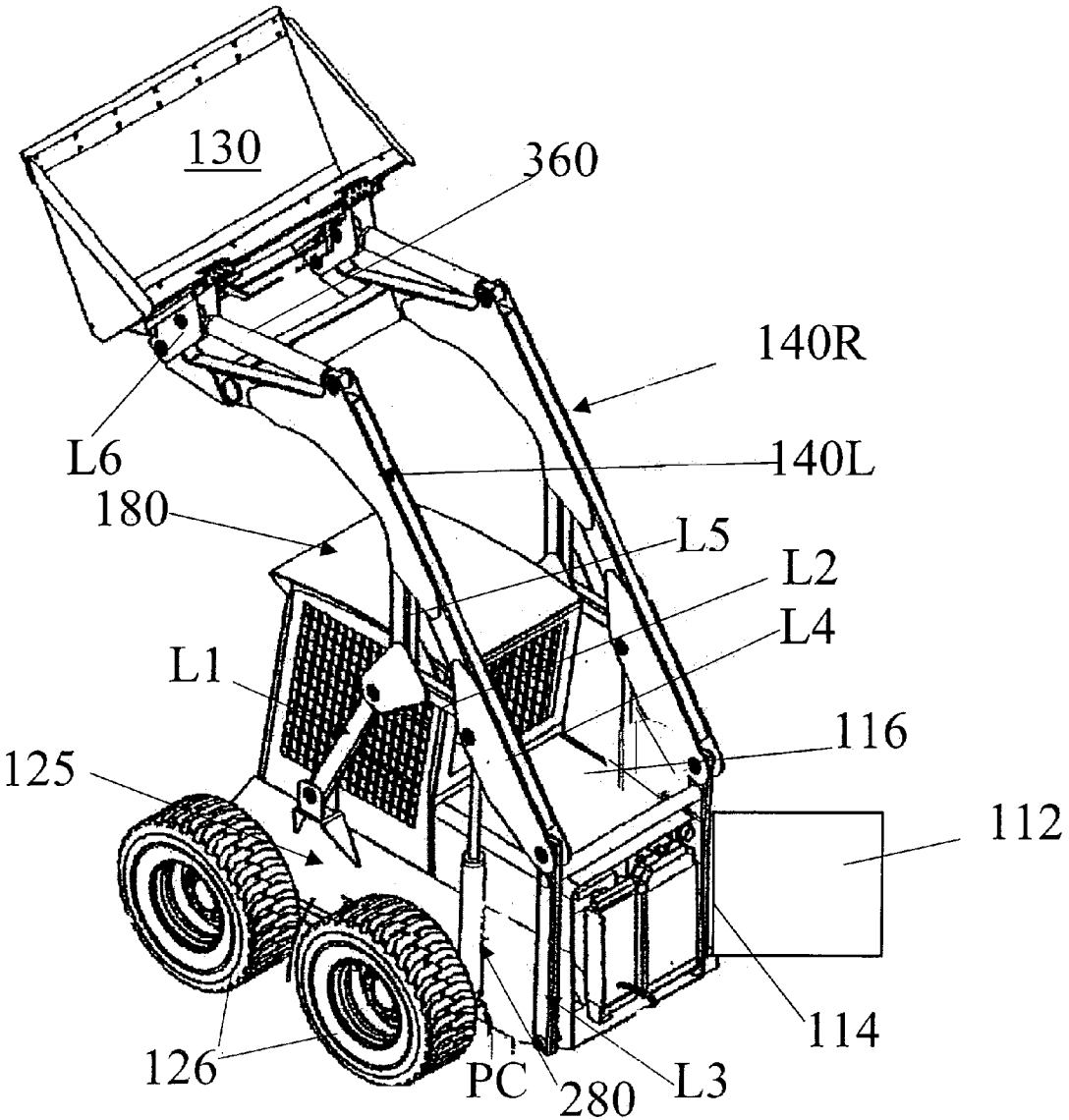
FIG. 2(C) is a rear left perspective view of a skid steer vehicle shown in FIG. 2(A)
Figure 2D:
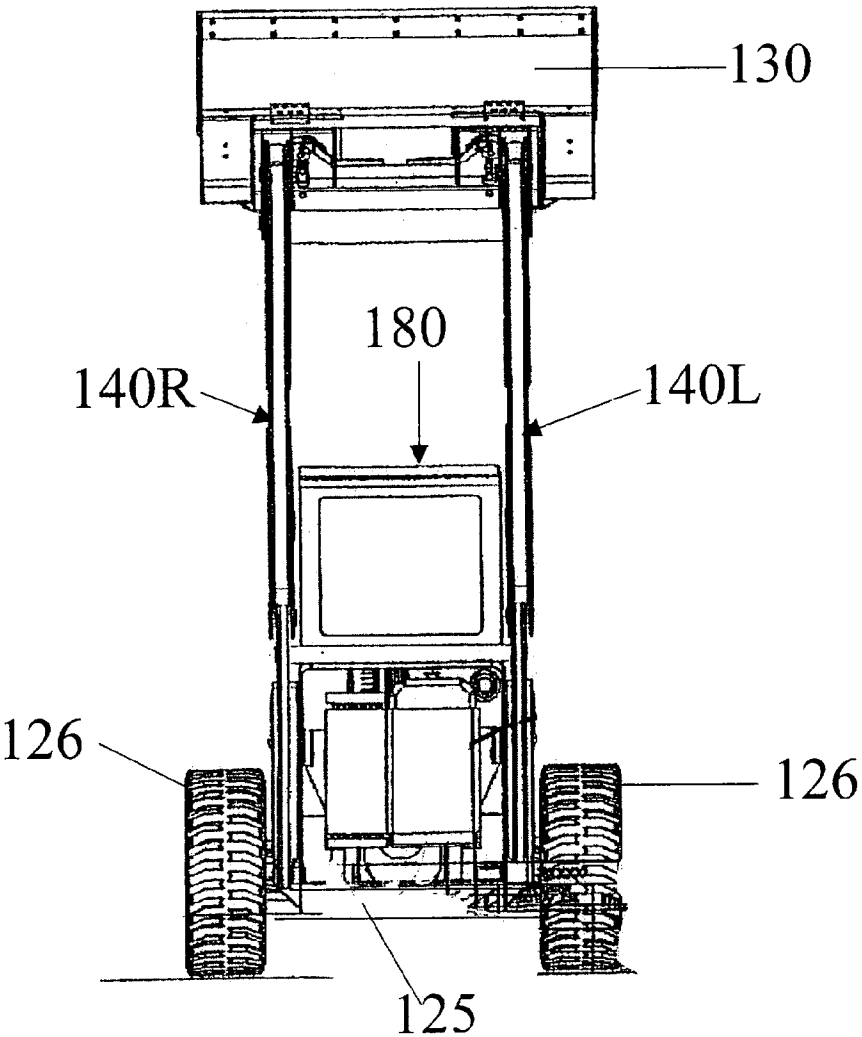
FIG. 2(D) is a rear view of the skid steer vehicle shown in FIG. 2(A)
Figure 2E:
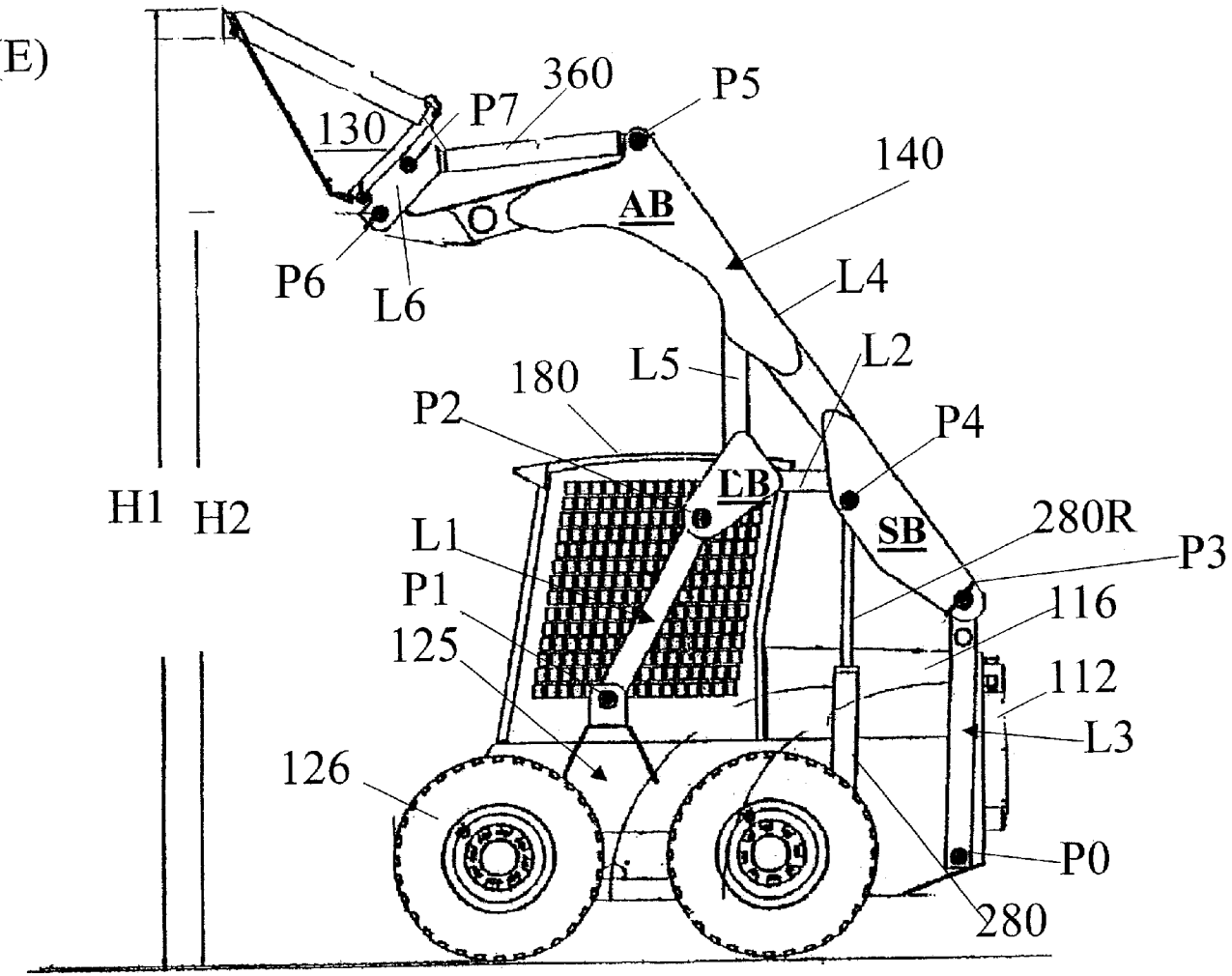
FIG. 2(E) is a left view of the skid steer vehicle shown in FIG. 2(A)
Figure 2F:
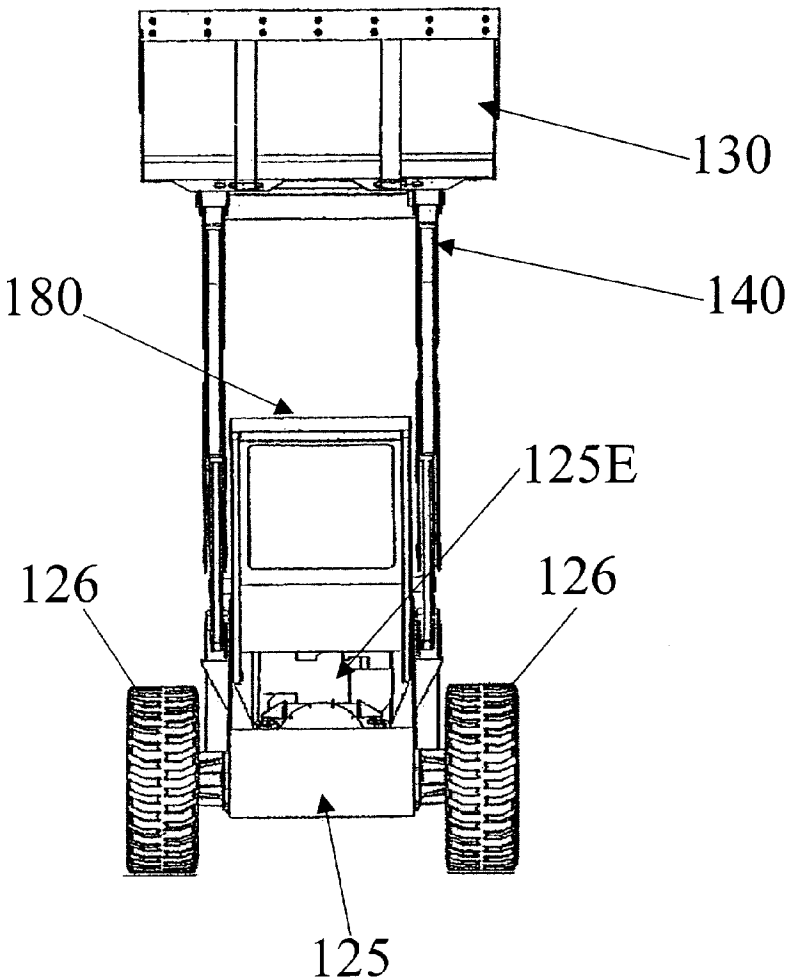
FIG. 2(F) is a front view of the skid steer vehicle shown in FIG. 2(A)

In some preferred embodiments, the boom includes respective boom assemblies 140 on left and right sides of the vehicle 100. Preferably, the boom assemblies include a front link L1 that is pivotally connected at a pivot P1 and a rear link L3 that is pivotally connected to the rear of the boom assembly 140 at rear boom pivot P3. The rear link L3 is preferably connected to vehicle 100 by a rear mount P0. As shown in FIG. 2(E), the boom preferably includes a utility mechanism mounted thereon, such as in some illustrative examples, a bucket as shown. In that regard, the bucket 130 is preferably connected to each boom 140 via pivot P6 and is preferably raised and lowered by at least one hydraulic cylinder 360 connected to bucket 130 via a pivot P7. In addition, the hydraulic cylinder 360 is preferably connected to the boom 140 at a pivot P5.

In some preferred embodiments, the boom linkage provides substantially unobstructed left and/or right side access via a passage LH formed between links L1, L2, L3 and L4 as shown in FIG. 2(E). Preferably, the link L3 is located proximate a rear end of the body 125. The links L2 and L4 are preferably sufficiently high so as to enable an average size maintenance and/or service operator to readily lean through the passage LH. In some embodiments, when in the raised position shown in FIG. 2(E) and/or FIG. 3, the link L2 is at least about 5 feet above the ground surface, or, more preferably, at least over about 5½ feet above the ground surface, or, more preferably, at least about 6 feet above the ground surface. In some embodiments, the links L1 and L3 are preferably spaced apart from one another a sufficient distance to provide a wide passage thereunder, such as, e.g., spaced apart at least about 3 feet, or, more preferably, at least about 3½ feet, or, more preferably, at least about 4 feet at a level just above the top of the body 125. Preferably, the links L1 and L3 extend generally upright when the boom is in the extended position. In that regard, the link L1 preferably extends substantially upright at an angle of greater than about 40 degrees from horizontal, or, more preferably, greater than about 45 degrees from horizontal, or, more preferably, greater than about 50 degrees from horizontal when the boom is in the extended position. In addition, the link L3 preferably extends substantially upright at an angel of greater than about 70 degrees from horizontal, or, more preferably, greater than about 80 degrees from horizontal, or, more preferably, approximately about 90 degrees from horizontal when the boom is in the extended position.

In some preferred embodiments, the links L1, L2, L3 and L4 are configured so as to allow substantially left and/or right side access. Preferably, the links L1 and/or L3 have, for example, a cross-sectional width in a fore-to-aft direction of the vehicle of less than about 1 foot, or, more preferably, less than about 9 inches, or, more preferably, less than about 6 inches.

In some preferred embodiments, the boom can include links L1–L6 substantially as illustrated in, e.g., FIG. 3. In that regard, the link L1 is preferably pivotally attached to the body 125 at a pivot P1 and is pivotally attached to a bracket LB at a pivot P2. In some embodiments, the link L3 can be pivotally attached to the body 125, such as, e.g., at a pivot P0. In some embodiments, the link L3 can be fixedly attached to the body 125 so as to extend generally upright therefrom. In some embodiments, the link L4 can be pivotally attached to the link L3 at a location above the top of the body 125, such as, e.g., as shown. Preferably, the link L4 is an elongated member that extends from the link L3 to a top of the boom. In the illustrated embodiment, the link L4 is generally L-shaped and includes a cylinder 360 connected between a pivot P5 on the link L4 and a pivot P6 on a link L6. In some embodiments, a utility mechanism, such as, e.g., a bucket 130, as shown, can be connected to the link L6 and pivotally attached to the link L4 via a pivot P6. Preferably, the link L4 includes a top angle bracket AB and/or a bottom support bracket SB to facilitate pivotal mounting and/or for enhanced strength and durability. In some embodiments, the links L2 and/or L5 can be pivotally connected to the link L4 (such as, e.g., via brackets AB and/or SB) and/or pivotally connected to the bracket LB. In some embodiments, the links L2 and/or L5 can be fixedly connected to the link L4 (such as, e.g., via brackets AB and/or SB) and/or fixedly connected to the bracket LB. In some embodiments, the links L2 and/or L5 can be unitarily formed with the link L4.

In some embodiments, the boom can be raised and/or lowered via at least one cylinder 280. In some preferred embodiments, the cylinder 280 is an hydraulically powered cylinder with an extendable cylinder rod 280R. A base end of the cylinder is preferably pivotally attached to the body 125, while a distal end of the cylinder rod is preferably pivotally attached to the link L4. In preferred embodiments, when in a raised position, the cylinder 280 and its cylinder rod extend generally upright so as to facilitate access on either side thereof. For example, in some illustrative embodiments, in an upright position, the cylinder is generally vertical, such as, e.g., within about 85–95 degrees from horizontal.

In some illustrative embodiments, the cylinder 280 is hydraulically operated and is connected to the boom 140 at pivot P4. As shown in FIG. 2(C), the boom cylinder 280 is also preferably connected to the vehicle 100 at the pivot PC, such as shown in phantom lines in FIG. 1(E).

In the most preferred embodiments, as shown in FIG. 3, an upwardly extending front link (such as, in for example, link L1) extends from the vehicle body and intersects with a mid-region of an elongated boom (such as, for example, proximate a mid-region of the link L4) via a pivot and a rear link (such as, e.g., link L3) extends upward from the vehicle body and connects proximate a bottom of the elongated boom. Preferably, the front link and the rear link connect to the vehicle body at locations spaced apart from one another in a fore-to-aft direction of the vehicle body a distance greater than about ½ of the fore-to-aft length of the vehicle body and, more preferably, a distance greater than about ⅔ of the fore-to-aft length of the vehicle body.

In some preferred embodiments, the boom is configured so that in a raised position (such as, e.g., shown in FIGS. 2(A)–2(F) and/or FIG. 3) the top of the bucket 130 is at a height H1 of about 125 to 175 inches (in one example, about 150 inches) and the bottom of the bucket 130 is at a height H2 of about 100 to 130 inches (in one example, about 115 inches). In some preferred embodiments, the structure of the vehicle can be sized and configured with dimensions substantially as shown in FIGS. 1(A) to 2(F) and/or FIG. 3, with such figures being substantially proportional and to scale in some illustrative and non-limiting embodiments of the invention.

Broad Scope of the Invention:

While illustrative embodiments of the invention have been described herein, the present invention is not limited to the various preferred embodiments described herein, but includes any and all embodiments having modifications, omissions, combinations (e.g., of aspects across various embodiments), adaptations and/or alterations as would be appreciated by those in the art based on the present disclosure. The limitations in the claims are to be interpreted broadly based on the language employed in the claims and not limited to examples described in the present specification or during the prosecution of the application, which examples are to be construed as non-exclusive. For example, in the present disclosure, the term "preferably" is non-exclusive and means "preferably, but not limited to." Means-plus-function or step-plus-function limitations will only be employed where for a specific claim limitation all of the following conditions are present in that limitation: a) "means for" or "step for" is expressly recited; b) a corresponding function is expressly recited; and c) structure, material or acts that support that structure are not recited.

What is claimed is:

1. A utility vehicle having an extendable utility boom, comprising:

a) a vehicle body;

a) an engine supported within said vehicle body;

b) a boom supported over said body;

c) a utility mechanism supported by said boom;

d) an operator cab supported by said vehicle body; and e) (i) a forward tilt mechanism about which said cab tilts forward for maintenance or service; and (ii) a boom linkage moveable between a retracted position and an extended position, wherein in said extended position said boom linkage provides substantially unobstructed access to the vehicle body from left and right sides of the vehicle from between a substantial portion of a fore-to-aft length of the vehicle body; and f) wherein said boom linkage includes a front link mounted proximate a front side of the vehicle body and a rear link mounted proximate a rear side of the vehicle body, wherein when in said raised position, said front link and said rear link provide a opening therebetween enabling substantially unobstructed access for maintenance service;

and further including g) a removable top cover that provides access over substantially the entire top side of the engine behind said cab.

2. The utility vehicle of claim 1, wherein said substantial portion of the fore-to-aft length includes a substantial portion of the distance between a rear of the cab, when in a forward tilted position, to a rear of the vehicle body.

3. The utility vehicle of claim 1, further including a rear-end door that enables access from a rear of the vehicle for maintenance or service.

4. The utility vehicle of claim 1, wherein said vehicle is a skid steer vehicle.

5. The utility vehicle of claim 1, wherein said utility mechanism includes a bucket.

6. The utility vehicle of claim 1, wherein said rear link has a width in a fore-to-aft direction of the vehicle of less than about one foot.

7. The utility vehicle of claim 1, wherein said rear link has a width in a fore-to-aft direction of the vehicle of less than about nine inches.

8. The utility vehicle of claim 1, wherein said rear link has a width in a fore-to-aft direction of the vehicle of less than about six inches.

9. The utility vehicle of claim 1, wherein when in said raised position, said front link extends upward toward a mid-region of an elongated boom, said rear link extends upward toward a bottom of the elongated boom, and said utility mechanism is supported proximate an upper end of said elongated boom.

10. A utility vehicle having an extendable utility boom, comprising:

a) a vehicle body;

b) an engine supported within said vehicle body;

c) an extendable boom supported over said body;

d) a utility mechanism supported on said boom;

e) an operator cab supported on said vehicle body; and f) means for providing substantially unobstructed access to said engine along left and right sides of said vehicle body from locations beneath said cab and beneath said boom to proximate a rear end of said vehicle body, wherein said means is a) a below-cab access mechanism that raises forwardly at least a rear of said cab for maintenance or service and b) said extendable boom having a forward link and a rearward link mounted upon said vehicle body, said forward link and said rearward link providing an opening therebetween enabling substantially unobstructed access for maintenance or services;

further including g) a removable top cover that provides access over substantially the entire top side of the engine behind said cab.

11. A utility vehicle having an extendable utility boom, comprising:

a) a vehicle body;

b) an engine supported within said vehicle body;

c) an extendable boom supported over said body;

d) a utility mechanism supported on said boom;

e) an operator cab supported on said vehicle body; and f) means for providing substantially unobstructed access to said engine along left and right sides of said vehicle body from locations beneath said cab and beneath said boom to proximate a rear end of said vehicle body, wherein said means is a) a below-cab access mechanism that raises forwardly at least a rear of said cab for maintenance or service and b) said extendable boom having a forward link and a rearward link mounted upon said vehicle body, said forward link and said rearward link providing an opening therebetween enabling substantially unobstructed access for maintenance or service wherein said below-cab access mechanism includes a forward tilt mechanism about which said cab tilts forward for maintenance or service;

further including g) a removable top cover that provides access over substantially the entire top side of the engine behind said cab.

12. The utility vehicle of claim 10, wherein said extendible boom provides substantially unobstructed access on right and left sides of the vehicle.

13. The utility vehicle of claim 10, wherein said extendible boom is moveable between a retracted position and an extended position, wherein in said extended position said extendible boom provides a substantially unobstructed access into the vehicle body from left and right sides of the vehicle body from between substantially a rear of the cab to a rear end of the vehicle body.

14. The utility vehicle of claim 10, further including a rear-end door that allows for access across substantially the entire rear end of the vehicle body.

15. The utility vehicle of claim 14, wherein said rear-end door is pivotally attached to pivot about a generally vertical axis.

16. A method of providing maintenance or service to a utility vehicle having an extendable boom, comprising:

a) providing a utility vehicle having: a vehicle body, an engine supported within said vehicle body, a boom supported over said body and having a forward link and a rearward link mounted upon said vehicle body, a utility mechanism supported on said boom, and an operator cab supported on said vehicle body;

b) raising said boom into a position providing substantially unobstructed access under said boom at left and right sides of the vehicle with said forward link and said rearward link providing an opening therebetween enabling substantially unobstructed access for maintenance or service; and c) tilting said cab forward around a forward tilt mechanism and maintaining said cab in a forward tilted position without additional tools;

further including d) removing a cover over a top of the engine to provide access to said vehicle body behind said cab.

17. The method of claim 16, further including opening a rear-end door that provides access from a rear of the vehicle for maintenance or service.

18. The method of claim 16, wherein said raising said boom includes raising said boom via a boom linkage that is moveable between a retracted position and an extended position, wherein in said extended position said boom linkage provides substantially unobstructed access into the vehicle from left and right sides of the vehicle from between substantially a rear of the cab to a rear end of the vehicle body.

* * * * *